US006341493B1

(12) United States Patent
Shepeck et al.

(10) Patent No.: US 6,341,493 B1
(45) Date of Patent: Jan. 29, 2002

(54) HVAC CONTROL AND METHOD FOR INTERPRETING BROAD RANGE OF INPUT VOLTAGES

(75) Inventors: Matthew A. Shepeck, Holmen; Ali S. Ameen; David M. Foye, both of La Crosse, all of WI (US)

(73) Assignee: American Standard International Inc., New York, NY (US)

( * ) Notice: Subject to any disclaimer, the term of this patent is extended or adjusted under 35 U.S.C. 154(b) by 33 days.

(21) Appl. No.: 09/619,684

(22) Filed: Jul. 19, 2000

(51) Int. Cl.[7] ..... F25D 25/00
(52) U.S. Cl. ..... 62/129
(58) Field of Search ..... 62/129, 125; 340/500; 323/299, 263, 210

(56) References Cited

U.S. PATENT DOCUMENTS 3,884,819 A * 5/1975 Schultz et al. ..... 422/186.09
3,899,684 A * 8/1975 Tenney ..... 422/186.11
3,978,311 A * 8/1976 Toth ..... 219/137.71
3,979,661 A * 9/1976 Matz ..... 363/89
4,082,999 A * 4/1978 Staker ..... 324/116
4,432,232 A * 2/1984 Brantley et al. ..... 73/865.9
4,716,357 A * 12/1987 Cooper ..... 323/263
5,138,192 A * 8/1992 Hsu ..... 327/50
5,198,698 A * 3/1993 Paul et al. ..... 307/64
5,325,312 A 6/1994 Kidd
5,451,746 A * 9/1995 Kadwell et al. ..... 219/506
5,612,609 A * 3/1997 Choi ..... 323/210
5,841,724 A * 11/1998 Ebel et al. ..... 365/226
5,903,145 A * 5/1999 Hemminger et al. ..... 324/142
5,973,489 A * 10/1999 Dourlain ..... 323/299
6,097,182 A * 8/2000 Hemminger et al. ..... 324/142
6,175,484 B1 * 1/2001 Caruthers et al. ..... 361/159

* cited by examiner

*Primary Examiner*—Teresa Walberg
*Assistant Examiner*—Daniel Robinson
(74) *Attorney, Agent, or Firm*—William J. Beres; William O'Driscoll

(57) ABSTRACT

An HVAC (heating, ventilating, and air conditioning) control and method for interpreting a broad range of input voltages generates a series of voltage pulses whose quantity increases with the amplitude of the input voltages. Upon counting the pulses or accumulating them across a capacitor, the control applies an algorithm to determine whether an input voltage should be interpreted as a logic-1 or a logic-0. The control can accept AC input voltages having nominal amplitudes of either 110 or 220-volts. In some embodiments, software-based hysteresis helps filter out electrical noise and distinguish input signals that are marginally between a logic-1 and a logic-0.

31 Claims, 5 Drawing Sheets

START
118
LOGIC = 0
120
122
P = 0
124
CTR = 0
126
INCREMENT CTR
128
COUNT PULSES FOR A PERIOD OF "T"
130
P ≥ HTPC ?
Y
N
CTR = REPS ?
132
N
Y
134
P = 0
136
LOGIC = 1
138
CTR = 0
148
COUNT PULSES FOR A PERIOD OF "T"
140
INCREMENT CTR
146
P = 0
142
P ≤ LTPC ?
Y
N
CTR = REPS ?
144
N
Y
145
LOGIC = 0
LOGIC STATE REMAINS UNCHANGED
143

HVAC CONTROL AND METHOD FOR INTERPRETING BROAD RANGE OF INPUT VOLTAGES

BACKGROUND OF THE INVENTION

1. Field of the Invention

The subject invention generally pertains to controls that may need to receive a broad range of input voltages (e.g., 110 to 220 VAC), as is often the case with systems pertaining to HVAC (heating, ventilating, and air conditioning), and the invention more specifically pertains to converting the broad range of input voltages to control signals of much lower voltage (e.g., 0 to 5 volts).

2. Description of Related Art

Electronic controls of commercial and industrial HVAC systems often need to receive and interpret input voltage signals that can range from a nominal 110 to 220 $V_{AC}$. Typically, 110 volts is used in the United States, while 220 volts is more common in other countries. However, many controls need to handle both 110 and 220 volts.

The relatively high input voltages typically come from sensing the condition of various HVAC devices such as motor starters, contactors, relays, limit switches, flow switches for evaporator and condenser pumps, pressure switches for condenser shells, motor winding thermostats, electric heaters, etc. The input voltage signals provide the control with feedback on the operating condition or status of the HVAC system. In response to the feedback, the control may simply monitor the HVAC system or provide various output signals that adjust or vary the system's operation.

Such controls often include a microprocessor for analyzing the input and providing logical output responses to the HVAC system. Since many microprocessors operate on a binary system using voltage signals of no more than about five volts, the 110/220-volt inputs need to be reduced before they reach the microprocessor.

After reducing the input voltages to about 5 volts, the lower voltages are preferably electrically isolated from the higher voltages. The electrical isolation helps protect the microprocessor and its associated low-voltage components from being damaged by the higher voltages. Also, when troubleshooting a low-voltage portion of the control, electrical isolation helps protect a service technician from being accidentally shocked by higher voltages. Lastly, for UL approval, Underwriters Laboratories, Inc. requires electrical isolation between electrical lines of significantly different voltages.

Today, step-down transformers are often used for electrical isolation. However, transformers have several disadvantages. If a transformer reduces an input signal from 220 to five volts, that same transformer could reduce a 110-volt signal to an unacceptably low 2.5 volts. Thus, separate transformers are usually needed to handle both 110 and 220-volt inputs. A transformer's bulk also makes them generally incompatible with compact circuit boards using surface-mount technology. Moreover, micro-transformers have rather delicate wire for its windings, which tends to reduce the reliability and durability of such transformers.

Optical isolators are also often used for electrical isolation. An optical isolator typically turns on when an input voltage reaches a certain threshold, and otherwise turns off (with some hysteresis between its on and off states). The threshold is generally a fixed value that is dependent on other electrical components associated with the optical isolator. If the electrical characteristics of the optical isolator or its other related components vary due to their manufacturing tolerances, the threshold may vary accordingly. This can become a critical problem when an input voltage is at or very near the threshold.

For example, if an input voltage is just barely below the threshold, the input may be interpreted as a logic-0, i.e., turned off, when actually the input might be just a weak signal that should be interpreted as a logic-1.

Moreover, electrical isolation circuits employing optical isolators are typically designed to handle a generally narrow range of input voltages. Otherwise, such circuits may generate a significant amount of heat when receiving higher voltage signals.

Voltage spikes, electrical noise, and other electrical transients may falsely trip an optical isolator. Although high-frequency filters and other circuitry can be used to block most false signals, it can be difficult to provide a circuit that can anticipate and reject every imaginable form of electrical noise.

SUMMARY OF THE INVENTION

In order to receive and interpret a broad range of input voltages, a control translates the input voltage to a pulsating voltage whose number of pulses varies with the voltage amplitude of the input. The control includes an analog, digital, and/or software component that interprets the pulsating voltage to determine the value of the input voltage. The input's value may be the actual amplitude of the voltage or may simply be a binary value, such as a logic-0 or logic-1, which respectively represents the absence or presence of the input voltage.

In some embodiments, it is an object of the invention to determine the value of the input voltage by counting the pulses of the pulsating voltage.

In some embodiments, it is an object of the invention to determine the value of the input voltage by accumulating the pulsating voltage across a capacitor and then measuring the voltage across the capacitor.

In some embodiments, it is an object of the invention to determine the value of the input voltage by applying software logic in interpreting a count or an analog accumulation of the pulsating voltage.

In some embodiments, the software provides certain time-delays and/or hysteresis that filter out electrical noise or erroneous electrical spikes, thus avoiding misinterpreting an input.

Another object of the invention is to provide software-based hysteresis from logic-1 to logic-0 values and vice versa.

In some embodiments, it is an object of the invention to electrically isolate a lower voltage portion of the control from the higher voltage input, without having to rely on an isolation transformer.

Another object of the invention is to employ an optical isolator that electrically isolates one pulsating signal from another pulsating signal.

Another object is to take multiple count readings of pulses that indicate a voltage amplitude to avoid false readings based on a single count.

A further object of the invention is to provide a control that can receive and interpret both 110 and 220-volt inputs.

A still further object of the invention is to provide a high-resolution method of sensing a voltage by converting the voltage to a series of pulses whose number of pulses increases with the amplitude of the voltage, whereby increasing the number of pulses for a given voltage increases the resolution accordingly.

Another object is to provide a method of reliably interpreting an input using electrical components of standard tolerance.

Another object is to take full advantage of surface-mount technology by not using a transformer.

The present invention provides a control adapted to monitor an operating status of a system in response to receiving an input voltage having an input voltage amplitude and a nominal frequency. The control includes an input terminal adapted to receive the input voltage, and a first pulse circuit coupled to the input terminal and adapted to generate a first pulsating voltage having a first frequency that varies as a function of the input voltage amplitude the first frequency is at least as great as the nominal frequency when the input voltage amplitude is above an upper limit. The control also includes a second pulse circuit adapted to generate a plurality of pulses in response to the first pulsating voltage, an electrical isolator that helps isolate the plurality of pulses from the input voltage; and a logic circuit coupled to the second pulse circuit. The logic circuit selectively creates a first binary value in response to the plurality of pulses indicating the input voltage amplitude is above the upper limit and creates an opposite binary value in response to the plurality of pulses indicating the input voltage amplitude is below a lower limit. The first binary value and the opposite binary value at least partially provide an indication of the operating status of the system.

The present invention also provides a method of measuring an input voltage amplitude of an input voltage having a nominal frequency. The method comprises the steps of: sensing the input voltage; generating a pulsating voltage having a generated frequency that varies as a function of the input voltage amplitude; generating a plurality of pulses that vary as a function of the generated frequency; and counting the plurality of pulses to determine the input voltage amplitude.

The present invention additionally provides a method of interpreting an input voltage having a input voltage amplitude and a nominal frequency. The method includes: sensing the input voltage; generating a pulsating voltage having a generated frequency that varies as a function of the input voltage amplitude; generating a plurality of pulses that varies as a function of the generated frequency; and creating a first digital value based on the plurality of pulses, whereby the first digital value indicates that the input voltage amplitude has reached a certain value.

The present invention further provides a control suitable for an HVAC system that conditions the air of a comfort zone. The control is adapted to monitor an operating status of the HVAC system in response to receiving an input voltage having an input voltage amplitude and a nominal frequency. The control comprises an input terminal adapted to receive the input voltage, and a first pulse circuit coupled to the input terminal and adapted to generate a first pulsating voltage having a first frequency that varies as a function of the input voltage amplitude with the first frequency being at least as great as the nominal frequency when the input voltage amplitude is above an upper limit. The control also comprises a second pulse circuit adapted to generate a plurality of pulses in response to the first pulsating voltage, an electrical isolator that helps isolate the plurality of pulses from said input voltage; and a logic circuit coupled to the second pulse circuit. The logic circuit selectively creates a first binary value in response to the plurality of pulses indicating the input voltage amplitude is above the upper limit and creates an opposite binary value in response to the plurality of pulses indicating the input voltage amplitude is below a lower limit. The first binary value and the opposite binary value at least partially provide an indication of the operating status of the HVAC system.

DESCRIPTION OF THE PREFERRED EMBODIMENT

Figure 1:
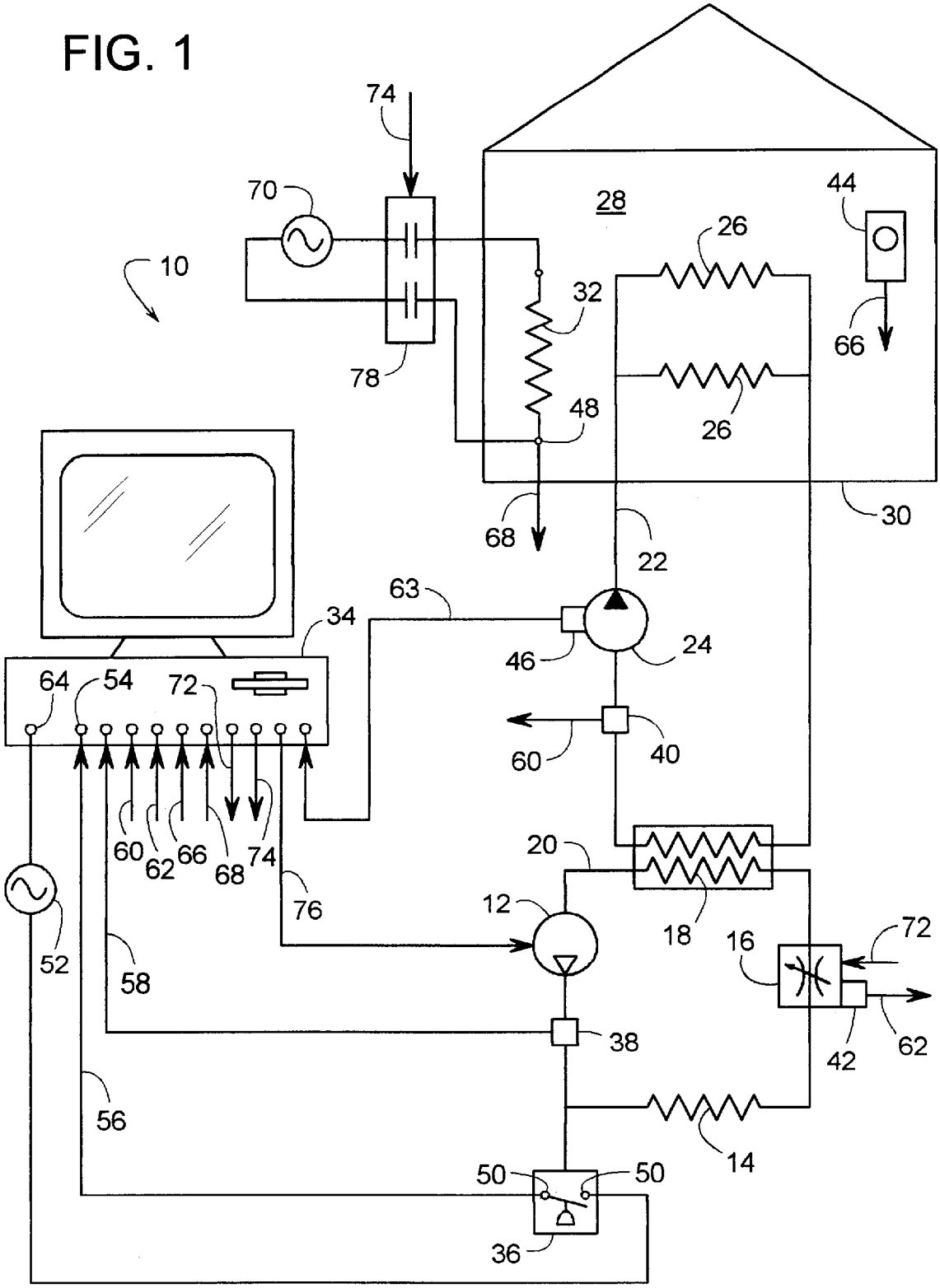
FIG. 1 is a schematic view of a system incorporating the subject invention.

An HVAC system 10, of FIG. 1, includes some of the basic components of typical HVAC systems. However, system 10 is not meant to represent any particular system, but is rather meant to illustrate some common system components and their functional relationships to each other.

System 10 includes a refrigerant compressor 12, a condenser 14, an expansion valve 16, and an evaporator 18, all of which are interconnected in a closed loop to comprise a conventional refrigerant circuit 20. In this generic example, evaporator 18 cools water that is circulated through a chilled water circuit 22. A pump 24 pumps the chilled water through one or more heat exchangers 26 that cools an area 28 within a building 30. Alternatively, to heat area 28, refrigerant flow through refrigerant circuit 20 can be reversed, and/or an electric heater 32 can be used.

To control or monitor the operation of system 10, a control 34 receives input or feedback from several sources. Control 34 is schematically illustrated to represent the myriad of controls that are suitable for controlling or monitoring a system in response to feedback. Control 34 can be based on digital circuitry, analog circuitry, software logic, and various combinations of the three. Examples of control 34 include, but are not limited to, computers, microcomputers, microprocessors, PLC's (programmable logic controller), voltage meters, IC's (integrated circuits), and other electrical circuits comprising discrete electrical components (analog and/or digital). Also, the system associated with control 34 does not necessarily have to be HVAC related, but rather can be almost any system or process that can be controlled or monitored in response to feedback.

The feedback sources or devices may include, but are not limited to, a pressure switch 36 that senses the discharge pressure of compressor 12, a temperature sensor 38 that senses the temperature of refrigerant being discharged from compressor 12, a flow sensor 40 that senses water flowing through circuit 22, a limit switch 42 that senses the position of an actuator acting upon expansion valve 16, a room thermostat 44, a motor starter 46 having main electrical contacts for starting and stopping pump 24 and having auxiliary contacts for feedback, and an electrical terminal 48 of heater 32. It should be appreciated by those skilled in the art that the devices just mentioned are for illustrative purposes only, and a wide variety of other feedback sources or devices are well within the scope of the invention.

Pressure switch 36 includes a set of normally open contacts 50 that close upon the refrigerant discharge pressure exceeding a certain limit. An electrical power source 52 delivers, for example, 110 $V_{AC}$ at a nominal 60 Hz frequency to one contact 50, while the other contact 50 connects to an input terminal 54 of control 34. Sufficient discharge pressure of compressor 12 closes contacts 50, which thus applies a 110 $V_{AC}$ feedback signal 56 to input terminal 54. Similarly, power source 52, supplies voltage to the other feedback devices; however, the electrical lines to do so have been omitted for clarity. Nonetheless, feedback devices 36, 38, 40, 42 and 46 use the 110 $V_{AC}$ that they receive to provide control 34 with feedback or input voltage on lines 56, 58, 60, 62 and 63 respectively. A terminal 64 on control 34 serves as a common or shared neutral node of power supply 52. Feedback from a thermostat is typically 24 $V_{AC}$ or less, but for illustration purposes thermostat 44, in this example, conveys a feedback signal 66 of 110 $V_{AC}$ to control 34. A 220 $V_{AC}$ feedback signal 68 from terminal 48 is created upon heater 32 being energized by a 220 $V_{AC}$ power source 70.

In response to inputs 56, 58, 60, 62, 63, 66 and 68, control 34 generates outputs 72, 74 and 76 using analog, digital and/or software control logic that follows well-known or otherwise preferred control schemes. In the example of FIG. 1, output 72 drives an actuator that determines the opening of valve 16, output 76 energizes a motor starter for turning compressor 12 on, and output 74 turns heater 32 on and off by way of a contactor 78.

Figure 2:
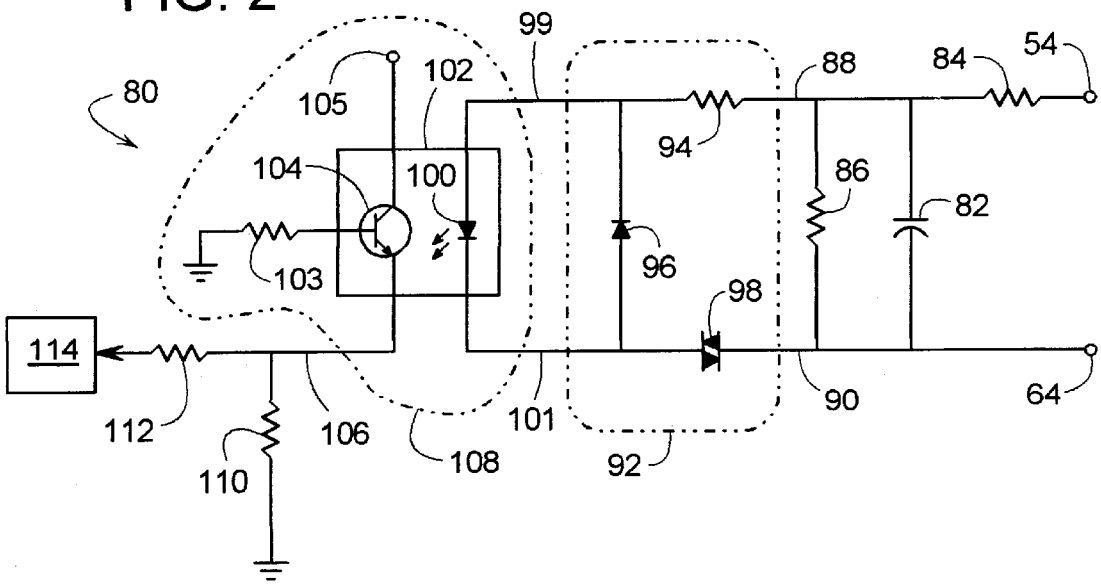
FIG. 2 is an electrical schematic of one embodiment of an input circuit.

In order for control 34 to readily apply low voltage control logic to create outputs in response to relatively high voltage inputs, each input 56, 58, 60, 62, 63, 66 and 68 is first delivered to an input circuit 80 of control 34, as shown in FIG. 2. Thus, in this example, control 34 includes seven input circuits 80 to receive the seven inputs of system 10. Circuit 80 will be explained with reference to input 56 from pressure switch 36; however, the same general idea applies to the other inputs as well.

Circuit 80 includes a 0.022 uF capacitor 82 and two 140 k-ohm resistors 84 and 86 that provide a 60-hertz pulsating voltage of 55 $V_{AC}$ (i.e., 55 volts rms, 156 volts peak-to-peak) across points 88 and 90 upon receiving 60-hertz 110 $V_{AC}$ (i.e., 110 volts rms, 311 volts peak-to-peak) across terminals 54 and 64.

The 55 $V_{AC}$ across points 88 and 90 is fed into a first pulse circuit 92 that includes a 309-ohm resistor 94; a diode 96; and a diac 98, such as a D-30 provided by Semiconductors, Inc. of Riviera Beach, Fla. Diac 98 conducts current upon applying sufficient voltage (i.e., trigger voltage) across diac 98 and continues to conduct until the voltage drops to a minimum voltage required to sustain conduction. In some embodiments, the voltage that triggers diac 98 to conduct is about 26 to 38 volts; however, diacs of other trigger voltage levels can also be used.

Each positive voltage pulse (i.e., the positive half of the voltage waveform) at point 88 charges capacitor 82. When the capacitor voltage exceeds the trigger voltage of diac 98, capacitor 82 begins discharging through resistor 94, diac 98, and an LED 100 (light emitting diode) of an optical isolator 102, such as a 4N35 provided by Siemens of Germany. Diac 98 in its conducting state drains the voltage at a point 99 across LED 100 until the voltage across diac 98 is sufficiently low to cause diac 98 to stop conducting. If capacitor 82 is still sufficiently charged, the voltage across diac 98 again increases to trigger diac 98 another time. Repeatedly triggering diac 98 creates a series of current pulses that pass through LED 100. This continues until the voltage across capacitor 82 is insufficient to trigger diac 98.

Each pulse of current through LED 100 causes a transistor 104 of optical isolator 102 to conduct a 5 $V_{DC}$ source 105 to an output 106 of a second pulse circuit 108. Thus, output 106 carries a series of 5-volt pulses that correspond in frequency and number to the pulsating voltage at point 99. The actual number of pulses depends on the magnitude of positive charge across capacitor 82, and thus depends on the peak voltage of each positive half of the waveform of input voltage 56: the greater the peak voltage, the greater the number of pulses.

To ensure clear distinct pulses at output 106, a 130 k-ohm resistor 110 drains any residual charge that may otherwise remain at output 106 when transistor 104 is not conducting. A 1M-ohm resistor 103 connects the base of transistor 104 to ground. A 100 k-ohm resistor 112 conveys the 5-volt pulses to a logic circuit 114 that counts the pulses to determine whether input voltage 56 should be considered as a logic-0 or logic-1. In this case, logic-0 generally means that input voltage 56 is below a lower threshold (e.g., 40 volts-rms), and logic-1 generally means that input voltage 56 is above an upper threshold (e.g., 70 volts-rms). Within a deadband or hysteresis between 40 and 70 volts, the input voltage's assigned state, logic-0 or logic-1, remains unchanged.

During the negative half of the waveform of input voltage 56, diode 96 conducts to discharge capacitor 82 across resistor 94. Also, the rather small voltage across points 99 and 101 (approximately 0.6 volts created by current passing through diode 96) is of a polarity that is opposite of that which is needed to operate LED 100. Thus, pulses at output 106 generally only occur during the positive half of the waveform of input voltage 56.

Figure 3:
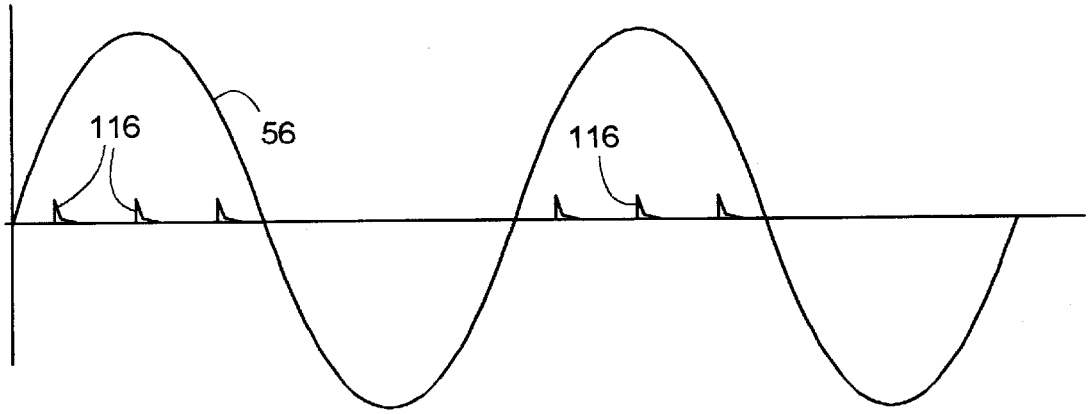
FIG. 3 is a graph showing voltage (ordinate) plotted versus time (abscissa) for an input voltage and smaller voltage pulses generated from the input voltage.
Figure 4:
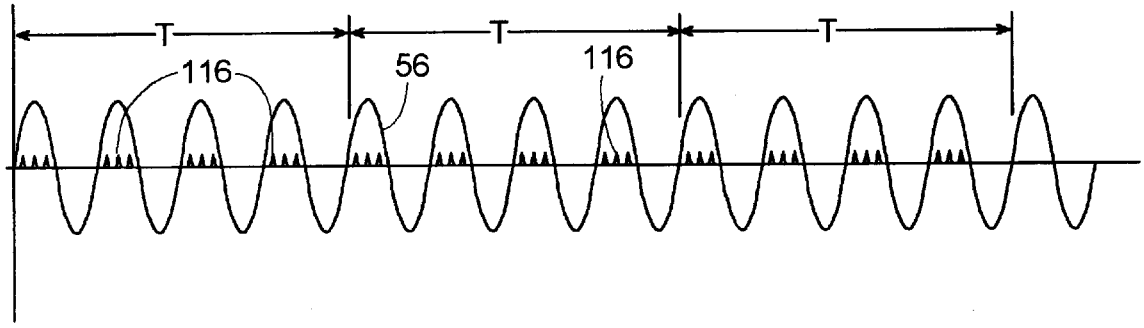
FIG. 4 is the same as FIG. 3, but plotted over a longer period.
Figure 5:
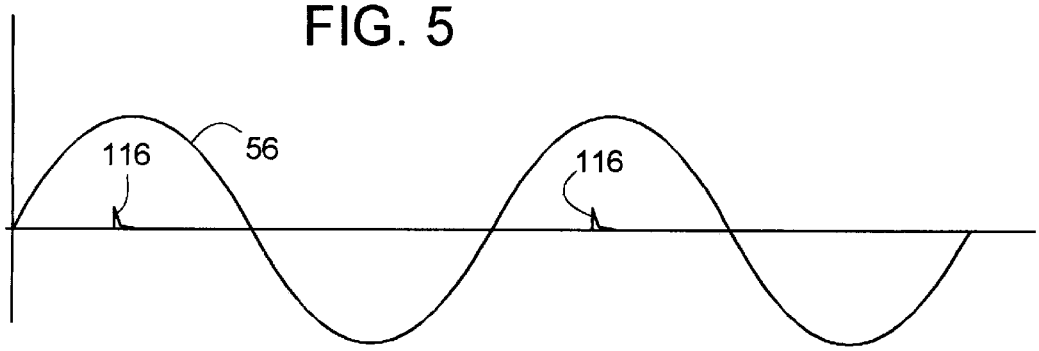
FIG. 5 is similar to FIG. 3, but showing how a lower input voltage generates fewer pulses.

This can be more clearly understood by referring to FIGS. 3 and 4. When input voltage 56 is above an upper threshold (e.g., 70 volts), each positive half of the waveform generates a certain number of voltage pulses 116 at point 99 (e.g., 110 volts might produce three pulses). The actual number can be much more or less than three; however, the number increases with the amplitude of input voltage 56. Likewise, if input voltage 56 drops from 110 volts to 70 volts, the number of pulses at point 99, and thus at 106, will decrease (e.g., may drop from three to one, as shown in FIG. 5). It is possible that no pulses would be generated if input voltage 56 drops below a lower threshold (e.g., 40 volts). When input 56 is between the upper and lower thresholds (e.g., between 40 and 70 volts), some pulses may be generated, but they may occur less frequently than at every positive half of the input waveform.

Figure 6:
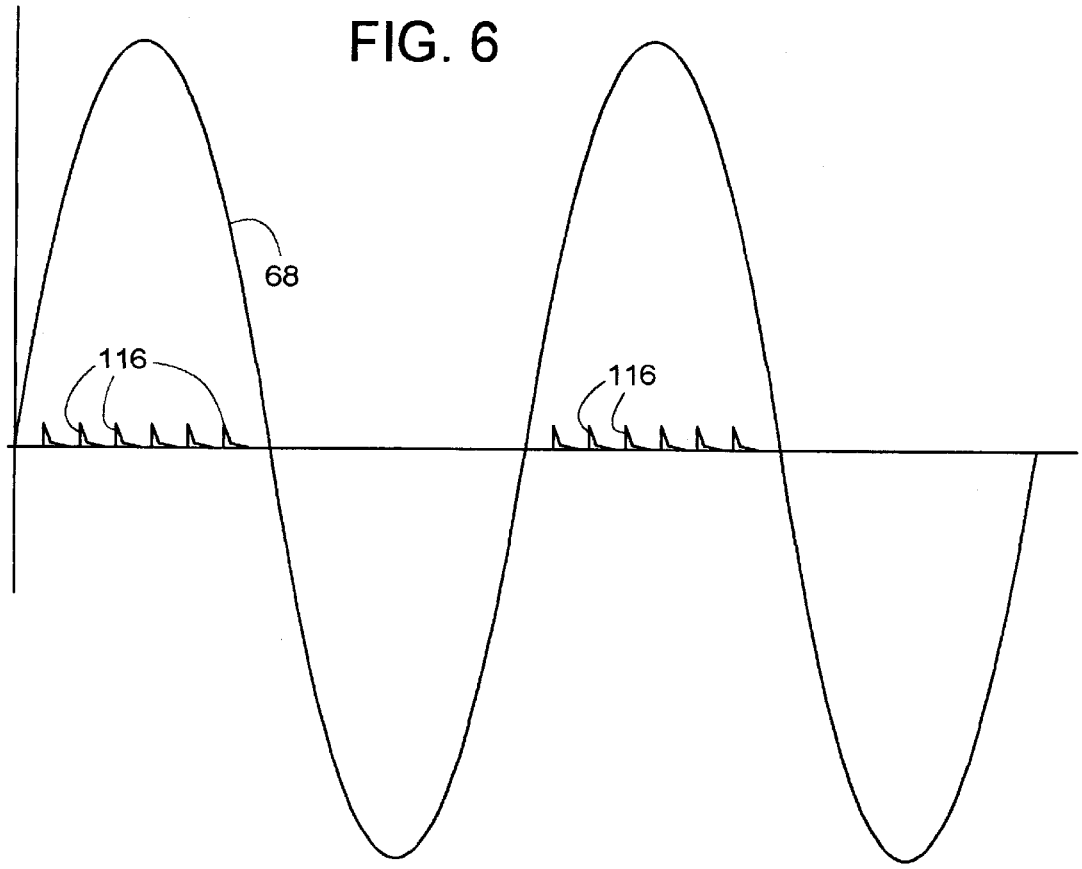
FIG. 6 is similar to FIG. 3, but showing how a higher input voltage generates more pulses.

If the input voltage is 220-volts at 60 hertz, as is the case with feedback 68 of heater 32, each positive half of the waveform generates many ore voltage pulses 116 at point 99 than what is produced by a 110-volt input. Thus, feedback 68 being t 220 volts also produces a corresponding higher number of 5-volt pulses at output 106, as shown in FIG. 6. The average generated frequency of the pulses or the average rate at which they occur is several times greater than the nominal 60-hertz frequency of input 68. And the generated frequency of the pulses or rate at which they occur increases with the amplitude of the input voltage.

Figure 7:
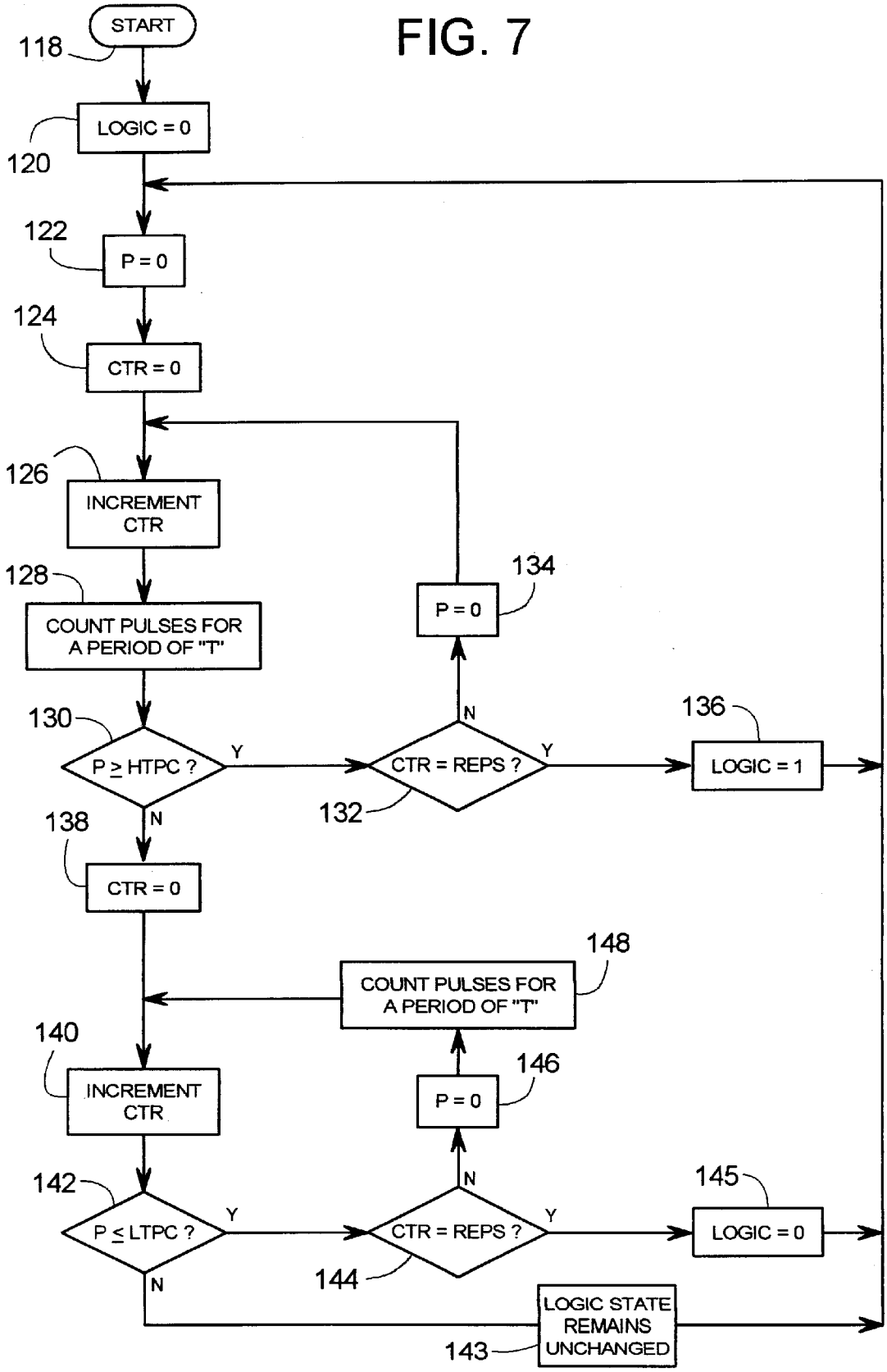
FIG. 7 is a control algorithm according to one embodiment of the invention.

In some embodiments of the invention, to determine whether an input voltage should be interpreted as a logic-0 or a logic-1, control 34 counts the number of pulses 116 over a given period by counting the number of 5-volt pulses at output 106 and then applying the logic algorithm of FIG. 7.

Block 118 starts the algorithm, control block 120 initializes the state of input 56 to be a logic-0, block 122 sets the count of pulses 116 to be zero, and block 124 resets a counter CTR to zero. Block 126 increments CTR to one, block 128 commands control 34 to count the number of pulses 116 over a predetermined period "T." The period T can be any reasonable predetermined value, such as 50 ms, 500 ms, etc., as shown in FIG. 4. Decision block 130 determines whether the number of pulses is at least as many as a predetermined high threshold pulse count (HTPC) or the number that would occur if input voltage 56 were at a minimum level indicative of a logic-1. Thus, if P is equal to or greater than HTPC), block 130 directs control to decision bock 132. In block 132, counter CTR is compared to a predetermined number of repetitions (REPS) that is a constant value selected to provide more or less sensitivity. Here, REPS has been assigned a value of three as an example. Counter CTR tallies the number of times that a count has been taken of pulses 116. Since only one count has been taken so far, block 132 directs control onto block 134, which resets the previous count of pulses 116 back to zero. Block 126 increments CTR to two, and a second count of pulses 116 is carried out at block 128. If the second count is also greater than or equal to HTPC, then decision block 130 again directs control to decision block 132. Since CTR is now two and still less than three, block 132 directs control to block 134, which again resets P back to zero. Block 126 increments CTR to three and a third count of pulses 116 is performed at block 130. Since P is still greater than or equal to HTPC and CTR is now equal to three, blocks 130 and 132 pass control onto block 136, which assigns a binary value of logic-1 to input 56. From block 136, control returns to block 122, and the process repeats until there are significant reductions in the number of pulses 116 counted over REPS periods of T (e.g., three periods of T).

If at decision block 130 input voltage 56 is sufficiently low to provide a count P that is less than HTPC, block 130 transfers control to block 138, which resets CTR to zero. Block 140 then increments CTR to one. If count P is more than a lower threshold pulse count (LTPC), the assigned binary value of input 56 (logic-1 or logic-0) remains unchanged, and decision block 142 returns control to block 122 via block 143. However, if count P is less than or equal to LTPC, block 142 transfers control to decision block 144. Since CTR equals one and is thus unequal to three, block 144 transfers control to block 146, which resets P to zero. Block 148 initiates a second count of P for another period of T, block 140 increments CTR to two, and decision block 142 compares the P count to LTPC. Block 140, 142, 144, 146 and 148 operate in a manner similar to blocks 126, 130, 132, 134 and 128; however decision block 130 sets one threshold (e.g., P≧HTPC) for changing from a logic-0 to a logic-1, while decision block 142 sets another limit (e.g., P≦LTPC) for changing from a logic-1 to a logic-0. A logic-0 is set by block 145.

The difference between the HTPC of block 130 and the LTPC of block 142 provides a deadband or software hysteresis between the opposite binary values of logic-0 and logic-1 to prevent erratic oscillation between the two states.

Having a broad range of pulses between HTPC and LTPC to represent a relatively narrow input voltage range provides a resolution that may be appropriate for applications other than just distinguishing between a logic-1 and a logic-0. For example, such a resolution could be adequate for a voltage meter. Moreover, the value of the components (capacitor 82, diac 98, etc.) of input circuit 80 could readily be selected to provide an even broader pulse range between HTPC and LTPC, thereby making it possible to create a voltage meter with exceptionally high resolution.

Figure 8:
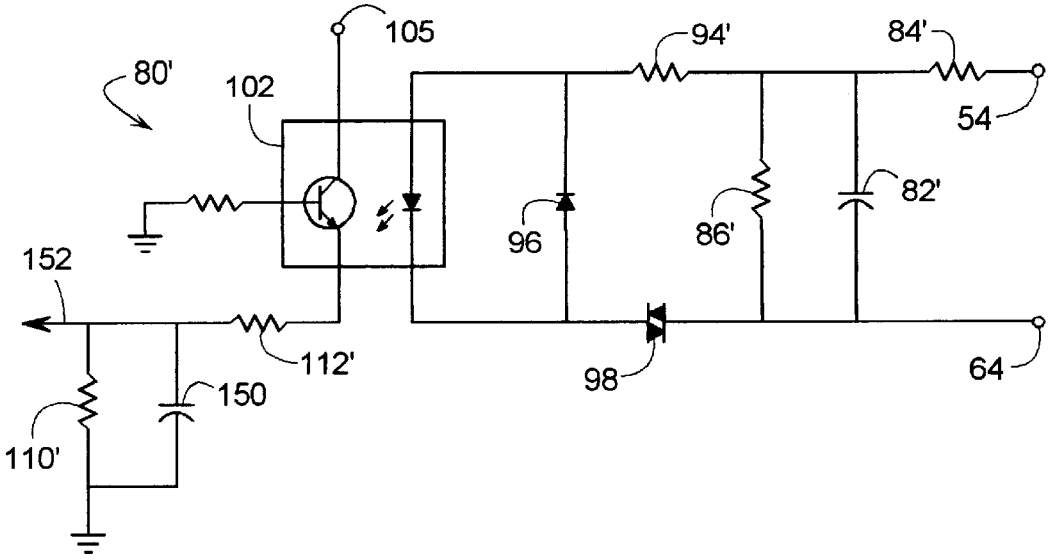
FIG. 8 is an electrical schematic of another embodiment of an input circuit.

FIG. 8 shows another embodiment of an input circuit 80', which is similar to circuit 80 of FIG. 2, but of an analog version. Instead of counting output pulses 114, the output pulses of circuit 80' are accumulated across a capacitor 150. The amplitude of the voltage across capacitor 150 is then measured at a point 152. If the voltage at point 152 rises to a predetermined high threshold (e.g., 2.5 volts), a logic-1 is assigned to the input voltage being applied across terminals 54 and 64. If the voltage at point 152 decreases below a predetermined low threshold (e.g., 0.5 volts), a logic-0 is assigned to the input voltage. A deadband or hysteresis is created by the difference between the high and low thresholds. In some embodiments, the value of the components are as follows: resistor 84' is 130 k-ohms, capacitor 82' is 0.027 uf, resistor 86' is 150 k-ohms, resistor 94' is 301-ohms, resistor 112' is 33-ohms, capacitor 150 is 0.33 uf, and resistor 110' is 200 k-ohms.

Although the invention has been described with reference to a currently preferred embodiment, it should be appreciated by those skilled in the art that other variations are well within the scope of the invention. For example, nominal frequencies other than 60-hertz can be used, such as 50-hertz and other frequencies. The terms, "isolating" and "isolator" refer to electrically insulated components that help inhibit electrical current from passing from one point to another and/or from passing from one electrical signal to another. Furthermore, the present invention is described in terms of an HVAC system, but is generally applicable to systems converting input signals to control signals of much lower voltage. Therefore, the scope of the invention is to be determined by reference to the claims, which follow.

We claim:

1. A control adapted to monitor an operating status of a system in response to receiving an input voltage having an input voltage amplitude and a nominal frequency, said control comprising:

an input terminal adapted to receive said input voltage;

a first pulse circuit coupled to said input terminal and adapted to generate a first pulsating voltage having a first frequency that varies as a function of said input voltage amplitude with said first frequency being at least as great as said nominal frequency when said input voltage amplitude is above an upper limit;

a second pulse circuit adapted to generate a plurality of pulses in response to said first pulsating voltage;

an electrical isolator that helps isolate said plurality of pulses from said input voltage; and a logic circuit coupled to said second pulse circuit and selectively creating a first binary value in response to said plurality of pulses indicating said input voltage amplitude is above said upper limit and creating an opposite binary value in response to said plurality of pulses indicating said input voltage amplitude is below a lower limit, whereby said first binary value and said opposite binary value at least partially provide an indication of said operating status of said system.

2. The control of claim 1, wherein said electrical isolator includes an optical isolator.

3. The control of claim 1, wherein said logic circuit counts said plurality of pulses over a certain period.

4. The control of claim 3, wherein said logic circuit counts said plurality of pulses during a plurality of periods to correspondingly create a plurality of counts, wherein said first binary value and said opposite binary value are based on said plurality of counts.

5. The control of claim 1, wherein said lower limit and said upper limit define a band of hysteresis therebetween, whereby said band of hysteresis allows said first binary value and said opposite binary value to remain unchanged while said control operates within said band of hysteresis.

6. The control of claim 1, further comprising a capacitor having a capacitor voltage created by an accumulation of said plurality of pulses, whereby said capacitor voltage indicates said input voltage amplitude.

7. The control of claim 1, wherein said plurality of pulses vary as a function of said first frequency in that said plurality of pulses coincide with said first frequency.

8. A method of measuring an input voltage amplitude of an input voltage having a nominal frequency, comprising:

sensing said input voltage;

generating a pulsating voltage having a generated frequency that varies as a function of said input voltage amplitude;

generating a plurality of pulses that vary as a function of said generated frequency; and counting said plurality of pulses to determine said input voltage amplitude.

9. The method of claim 8, wherein said generated frequency is greater than said nominal frequency.

10. The method of claim 8, further comprising creating a first binary value based on said plurality of pulses being indicative of said input voltage amplitude having exceeded an upper limit.

11. The method of claim 8, further comprising electrically isolating said plurality of pulses from said pulsating voltage.

12. The method of claim 8, further comprising electrically isolating said plurality of pulses from said input voltage.

13. The method of claim 8, further comprising selectively creating a first binary value and an opposite binary value based on a count of said plurality of pulses.

14. The method of claim 8, further comprising:

counting said plurality of pulses during a plurality of periods to correspondingly create a plurality of counts; and selectively creating a first binary value and an opposite binary value based on said plurality of counts.

15. The method of claim 14, wherein said counting provides a count, and further comprising comparing said count to an upper limit and a lower limit that define a band of hysteresis therebetween, and changing between a first binary value and an opposite binary value upon said count changing from being within said band of hysteresis to beyond said band of hysteresis.

16. The method of claim 8, further comprising charging a capacitor with an accumulation of said plurality of pulses, whereby said capacitor develops a capacitor voltage that indicates said input voltage amplitude.

17. The method of claim 16, further comprising defining an upper limit, a lower limit, and a band of hysteresis therebetween for said capacitor voltage; and changing between a first binary value and an opposite binary value upon said capacitor voltage changing from being within said band of hysteresis to beyond said band of hysteresis.

18. The method of claim 8, wherein said plurality of pulses vary as a function of said generated frequency in that said plurality of pulses occur substantially at said generated frequency.

19. A method of interpreting an input voltage having a input voltage amplitude and a nominal frequency, comprising:

sensing said input voltage;

generating a pulsating voltage having a generated frequency that varies as a function of said input voltage amplitude;

generating a plurality of pulses that varies as a function of said generated frequency; and creating a first digital value based on said plurality of pulses, whereby said first digital value indicates that said input voltage amplitude has reached a certain value.

20. The method of claim 19, wherein said generated frequency is greater than said nominal frequency.

21. The method of claim 19, further comprising counting said plurality of pulses.

22. The method of claim 19, further comprising electrically isolating said plurality of pulses from said pulsating voltage.

23. The method of claim 19, further comprising electrically isolating said plurality of pulses from said input voltage.

24. The method of claim 23, wherein said electrically isolating involves the use of an optical isolator.

25. The method of claim 21, further comprising:

counting said plurality of pulses during a plurality of periods to correspondingly create a plurality of counts; and creating said digital value based on said plurality of counts.

26. The method of claim 19, wherein said first digital value is one of two opposite binary values.

27. The method of claim 21, wherein said counting provides a count, and further comprising comparing said count to an upper limit and a lower limit that define a band of hysteresis therebetween, and selectively assigning said first digital value a first binary value and an opposite binary value upon said count changing from being within said band of hysteresis to beyond said band of hysteresis.

28. The method of claim 19, further comprising charging a capacitor with an accumulation of said plurality of pulses, whereby said capacitor develops a capacitor voltage that indicates said input voltage amplitude.

29. The method of claim 28, further comprising defining an upper limit, a lower limit, and a band of hysteresis therebetween for said capacitor voltage; and selectively assigning said first digital value a first binary value and an opposite binary value upon said capacitor voltage changing from being within said band of hysteresis to beyond said band of hysteresis.

30. The method of claim 19, wherein said plurality of pulses varies as a function of said generated frequency in that said plurality of pulses occurs substantially at said generated frequency.

31. A control suitable for an HVAC system that conditions the air of a comfort zone, wherein said control is adapted to monitor an operating status of said HVAC system in response to receiving an input voltage having an input voltage amplitude and a nominal frequency, said control comprising:

an input terminal adapted to receive said input voltage;

a first pulse circuit coupled to said input terminal and adapted to generate a first pulsating voltage having a first frequency that varies as a function of said input voltage amplitude with said first frequency being at least as great as said nominal frequency when said input voltage amplitude is above an upper limit;

a second pulse circuit adapted to generate a plurality of pulses in response to said first pulsating voltage;

an electrical isolator that helps isolate said plurality of pulses from said input voltage; and a logic circuit coupled to said second pulse circuit and selectively creating a first binary value in response to said plurality of pulses indicating said input voltage amplitude is above said upper limit and creating an opposite binary value in response to said plurality of pulses indicating said input voltage amplitude is below a lower limit, whereby said first binary value and said opposite binary value at least partially provide an indication of said operating status of said HVAC system.

* * * * *

UNITED STATES PATENT AND TRADEMARK OFFICE

CERTIFICATE OF CORRECTION

PATENT NO. : 6,341,493 B1 
DATED : January 29, 2002
INVENTOR(S) : Matthew A. Shepeck. Ali S. Ameen and David M. Foye It is certified that error appears in the above-identified patent and that said Letters Patent is hereby corrected as shown below:

Column 6,
Line 62, “ore” should read -- or --.
Line 65, “t” should read -- at --.

Signed and Sealed this

Eighteenth Day of June, 2002

*Attest:*

*Attesting Officer*

JAMES E. ROGAN
*Director of the United States Patent and Trademark Office*